US010468750B2

(12) United States Patent
Park

(10) Patent No.: US 10,468,750 B2
(45) Date of Patent: Nov. 5, 2019

(54) ANTENNA AND ELECTRONIC DEVICE INCLUDING THE SAME

(71) Applicant: Samsung Electronics Co., Ltd., Gyeonggi-do (KR)

(72) Inventor: Joo-Hwan Park, Gyeonggi-do (KR)

(73) Assignee: Samsung Electronics Co., Ltd (KR)

( * ) Notice: Subject to any disclaimer, the term of this patent is extended or adjusted under 35 U.S.C. 154(b) by 93 days.

(21) Appl. No.: 14/946,267

(22) Filed: Nov. 19, 2015

(65) Prior Publication Data

US 2016/0149291 A1 May 26, 2016

(30) Foreign Application Priority Data

Nov. 21, 2014 (KR) ..... 10-2014-0163756

(51) Int. Cl.

| | |
|---|---|
| ***H01Q 1/24*** | (2006.01) |
| ***H01Q 5/328*** | (2015.01) |
| ***H01Q 5/378*** | (2015.01) |
| ***H01Q 1/48*** | (2006.01) |

(52) U.S. Cl.

CPC ..... *H01Q 1/243* (2013.01); *H01Q 1/48* (2013.01); *H01Q 5/328* (2015.01); *H01Q 5/378* (2015.01)

(58) Field of Classification Search

CPC .. H01Q 1/241–244; H01Q 1/48; H01Q 5/328; H01Q 5/371; H01Q 5/378; H01Q 5/385; H01Q 19/005; H01Q 19/32; H01Q 3/446; H01Q 1/243

See application file for complete search history.

(56) References Cited

U.S. PATENT DOCUMENTS

| | | | | |
|---|---|---|---|---|
| 6,429,818 | B1 * | 8/2002 | Johnson | H01Q 1/243 343/700 MS |
| 2001/0050647 | A1 * | 12/2001 | Kanayama | H01Q 1/243 343/702 |
| 2003/0091183 | A1 * | 5/2003 | Holcombe | H04B 14/026 379/399.01 |
| 2007/0018749 | A1 * | 1/2007 | Yamaguchi | H01P 5/00 333/5 |
| 2011/0032165 | A1 | 2/2011 | Heng et al. | |

(Continued)

FOREIGN PATENT DOCUMENTS

| | | |
|---|---|---|
| CN | 202352836 | 7/2012 |
| CN | 102859791 | 1/2013 |

(Continued)

OTHER PUBLICATIONS

European Search Report dated Mar. 8, 2016 issued in counterpart application No. 15195550.7-1811, 9 pages.
European Search Report dated Mar. 9, 2017 issued in counterpart application No. 15195550.7-1927, 8 pages.
European Search Report dated Nov. 20, 2017 issued in counterpart application No. 15195550.7-1927, 8 pages.

(Continued)

*Primary Examiner* — Hoang V Nguyen
*Assistant Examiner* — Awat M Salih
(74) *Attorney, Agent, or Firm* — The Farrell Law Firm, P.C.

(57) ABSTRACT

Provided are an antenna and an electronic device including the same. The antenna includes a substrate, an antenna radiator fed from the substrate, at least one metallic member disposed near the antenna radiator, a connector member electrically connected to the substrate, and a capacitor formed by a dielectric interposed between the connector member and the at least one metallic member.

13 Claims, 17 Drawing Sheets

(56) References Cited

U.S. PATENT DOCUMENTS

| | | | | |
|---|---|---|---|---|
| 2011/0156963 | A1* | 6/2011 | Rajgopal | H01P 1/203 343/702 |
| 2012/0178382 | A1* | 7/2012 | Merz | H04B 1/38 455/73 |
| 2013/0090072 | A1 | 4/2013 | Lim et al. | |
| 2014/0126172 | A1 | 5/2014 | Fahlgren et al. | |
| 2014/0185721 | A1* | 7/2014 | Pajona | H01Q 1/243 375/347 |

FOREIGN PATENT DOCUMENTS

| | | | |
|---|---|---|---|
| KR | 1020130038515 | | 4/2013 |
| WO | WO 2007/096693 | | 8/2007 |
| WO | WO2007096693 | * | 8/2007 |
| WO | WO 2011/081630 | | 7/2011 |
| WO | WO 2014/046691 | | 3/2014 |
| WO | WO 2014/059382 | | 4/2014 |

OTHER PUBLICATIONS

Chinese Office Action dated Dec. 4, 2017 issued in counterpart application No. 201510816031.9, 20 pages.
Chinese Office Action dated Jul. 25, 2018 issued in counterpart application No. 201510816031.9, 12 pages.
EP Summons to Attend to Oral Proceedings dated Aug. 31, 2018 issued in counterpart application No. 15195550.7-1205, 8, 10 pages.
EP Brief Communication dated Feb. 27, 2019 issued in counterpart application No. 15195550.7-1205, 4 pages.

* cited by examiner

| Frequency | Efficiency | Average Gain | | |
|---|---|---|---|---|
| | | Ver | Hor | Total |
| 824.000000 MHz | 19.4% | -11.6dBi | -9.0dBi | -7.1dBi |
| 838.000000 MHz | 23.1% | -10.9dBi | -8.3dBi | -6.4dBi |
| 852.000000 MHz | 33.6% | -9.4dBi | -6.6dBi | -4.7dBi |
| 866.000000 MHz | 41.4% | -8.5dBi | -5.6dBi | -3.8dBi |
| 880.000000 MHz | 36.7% | -9.0dBi | -6.2dBi | -4.4dBi |
| 894.000000 MHz | 33.8% | -8.7dBi | -6.9dBi | -4.7dBi |
| Average | 31.4% | -9.7dBi | -7.1dBi | -5.2dBi |
| 880.000000 MHz | 36.7% | -9.0dBi | -6.2dBi | -4.4dBi |
| 894.000000 MHz | 33.8% | -8.7dBi | -6.9dBi | -4.7dBi |
| 896.000000 MHz | 37.2% | -8.9dBi | -6.1dBi | -4.3dBi |
| 912.000000 MHz | 30.0% | -9.7dBi | -7.1dBi | -5.2dBi |
| 928.000000 MHz | 22.5% | -11.0dBi | -8.4dBi | -6.5dBi |
| 944.000000 MHz | 30.3% | -9.7dBi | -7.1dBi | -5.2dBi |
| 960.000000 MHz | 20.1% | -11.4dBi | -8.9dBi | -7.0dBi |
| Average | 30.1% | -9.8dBi | -7.2dBi | -5.3dBi |
| 1710.000000 MHz | 25.9% | -9.7dBi | -8.2dBi | -5.9dBi |
| 1744.000000 MHz | 26.1% | -9.4dBi | -8.4dBi | -5.8dBi |
| 1778.000000 MHz | 29.6% | -8.6dBi | -8.0dBi | -5.3dBi |
| 1812.000000 MHz | 35.2% | -7.8dBi | -7.3dBi | -4.5dBi |
| 1846.000000 MHz | 55.3% | -6.0dBi | -5.2dBi | -2.6dBi |
| 1880.000000 MHz | 46.4% | -6.8dBi | -5.9dBi | -3.3dBi |
| Average | 36.4% | -8.0dBi | -7.2dBi | -4.6dBi |
| 1920.000000 MHz | 38.4% | -7.5dBi | -6.9dBi | -4.2dBi |
| 1970.000000 MHz | 42.7% | -6.8dBi | -6.6dBi | -3.7dBi |
| 2020.000000 MHz | 34.8% | -7.4dBi | -7.8dBi | -4.6dBi |
| 2070.000000 MHz | 29.4% | -8.0dBi | -8.7dBi | -5.3dBi |
| 2120.000000 MHz | 27.9% | -8.4dBi | -8.8dBi | -5.5dBi |
| 2170.000000 MHz | 20.8% | -9.4dBi | -10.3dBi | -6.8dBi |
| Average | 32.3% | -7.9dBi | -8.2dBi | -5.0dBi |

FIG.11A

| Frequency | Efficiency | Average Gain | | |
|---|---|---|---|---|
| | | Ver | Hor | Total |
| 824.000000 MHz | 20.4% | -11.3dBi | -8.8dBi | -6.9dBi |
| 838.000000 MHz | 24.6% | -10.6dBi | -8.0dBi | -6.1dBi |
| 852.000000 MHz | 35.5% | -9.1dBi | -6.3dBi | -4.5dBi |
| 866.000000 MHz | 43.2% | -8.4dBi | -5.4dBi | -3.6dBi |
| 880.000000 MHz | 38.3% | -8.9dBi | -6.0dBi | -4.2dBi |
| 894.000000 MHz | 35.0% | -8.5dBi | -6.8dBi | -4.6dBi |
| Average | 32.8% | -9.5dBi | -6.9dBi | -5.0dBi |
| 880.000000 MHz | 38.3% | -8.9dBi | -6.0dBi | -4.2dBi |
| 894.000000 MHz | 35.0% | -8.5dBi | -6.8dBi | -4.6dBi |
| 896.000000 MHz | 38.7% | -8.7dBi | -6.0dBi | -4.1dBi |
| 912.000000 MHz | 30.8% | -9.5dBi | -7.1dBi | -5.1dBi |
| 928.000000 MHz | 23.0% | -10.8dBi | -8.3dBi | -6.4dBi |
| 944.000000 MHz | 30.7% | -9.5dBi | -7.1dBi | -5.1dBi |
| 960.000000 MHz | 20.3% | -11.3dBi | -8.9dBi | -6.9dBi |
| Average | 31.0% | -9.6dBi | -7.2dBi | -5.2dBi |
| 1710.000000 MHz | 34.7% | -8.2dBi | -7.1dBi | -4.6dBi |
| 1744.000000 MHz | 32.6% | -8.3dBi | -7.5dBi | -4.9dBi |
| 1778.000000 MHz | 33.0% | -8.0dBi | -7.7dBi | -4.8dBi |
| 1812.000000 MHz | 38.9% | -7.1dBi | -7.2dBi | -4.1dBi |
| 1846.000000 MHz | 59.7% | -5.3dBi | -5.2dBi | -2.2dBi |
| 1880.000000 MHz | 46.0% | -6.7dBi | -6.1dBi | -3.4dBi |
| Average | 40.8% | -7.3dBi | -6.8dBi | -4.0dBi |
| 1920.000000 MHz | 37.6% | -7.6dBi | -6.9dBi | -4.2dBi |
| 1970.000000 MHz | 43.8% | -6.6dBi | -6.6dBi | -3.6dBi |
| 2020.000000 MHz | 35.3% | -7.3dBi | -7.8dBi | -4.5dBi |
| 2070.000000 MHz | 31.9% | -7.7dBi | -8.3dBi | -5.0dBi |
| 2120.000000 MHz | 33.2% | -7.7dBi | -7.9dBi | -4.8dBi |
| 2170.000000 MHz | 24.7% | -8.7dBi | -9.4dBi | -6.1dBi |
| Average | 34.4% | -7.6dBi | -7.8dBi | -4.7dBi |

FIG.11B

| ANTENNA | DESCRIPTION | LOW BAND ANT CHARACTERISTICS (GSM850/GMS900) | HIGH BAND ANT CHARACTERISTICS (DCS/PCS/W2100) | NOTE |
|---|---|---|---|---|
| 1 | Low Band Optimal Design | 29.85% | 33.25% | Open contact point |
| | High Band Optimal Design | 27.10% | 34.35% | Short contact point |
| 2 | Apply Switch | 30.75% | 34.35% | Better performance than 1 |
| 3 | Apply Capacitor | 31.90% | 37.60% | Better performance than 1 and 2 |

FIG.12

ANTENNA AND ELECTRONIC DEVICE INCLUDING THE SAME

PRIORITY

The present application claims priority under 35 U.S.C. § 119(a) to a Korean Patent Application filed in the Korean Intellectual Property Office on Nov. 21, 2014, and assigned Serial No. 10-2014-0163756, the entire contents of which are incorporated herein by reference.

BACKGROUND

1. Field of the Invention

The present disclosure relates generally to an electronic device, and more particularly to an electronic device including an antenna.

2. Description of the Related Art

As electronic communication technologies advance, electronic devices having various functions are being developed with a convergence function for conducting one or more functions.

In recent years, as functional gaps between manufacturers have narrowed, the electronic devices are being provided with reduced depth, i.e. are slimmer, in order to satisfy consumer's needs, to increase rigidity, and to enhance design. Increases in rigidity of the electronic devices are provided by replacing components, e.g., exterior components, with a metallic material, which concurrently appeals to consumer desire for high quality and improved exterior appearance. However, manufacturers must address grounding and antenna radiation reduction due to use of metallic material on the exterior of the electronic devices.

Antennas used in the electronic device include a Planar Inverted-F Antenna (PIFA) or a monopole radiator in a basic structure, with volume and number of the mounted antenna radiators determined based on a service frequency, bandwidth, and type. For example, the antenna needs to satisfy a wireless communication service operating in various bands such as Global System for Mobile communications (GSM), Long Term Evolution (LTE), Bluetooth (BT), Global Positioning System (GPS), and Wireless Fidelity (WiFi). The slimmer electronic devices must function in one or more of the communication bands, given the reduced mounting space provided for the antenna radiator, must produce an electric field below a Specific Absorption Rate (SAR) threshold for determining electromagnetic energy absorbed by a human body, and must overcome radiation degradation due to peripheral metallic members, e.g., a metallic housing, a metallic bezel, and electronic parts formed of metallic materials.

SUMMARY

The present invention has been made to address the above-mentioned problems and disadvantages, and to provide at least the advantages described below. Accordingly, an aspect of the present disclosure to provides an antenna and an electronic device for overcoming the above-discussed deficiencies.

Another aspect of the present invention provides an antenna and an electronic device for avoiding radiation degradation caused by a peripheral metallic member, e.g., a metallic housing, a metallic bezel, and an electronic part using a metallic material.

Another aspect of the present invention provides an antenna that decorates an exterior of the electronic device and concurrently enhancing radiation by forming at least part of the exterior with a metallic material.

A further aspect of the present invention provides an antenna and an electronic device that enhances antenna radiation by blocking a noise component in a low frequency band on a mounting condition thereof.

According to one aspect of the present invention, an antenna is provided that includes a substrate; an antenna radiator fed from the substrate; at least one metallic member disposed near the antenna radiator; a connector member electrically connected to the substrate; and a capacitor formed by a dielectric interposed between the connector member and the at least one metallic member.

According to another aspect of the present invention, an electronic device is provided that includes a substrate; an antenna radiator; a metallic member disposed near the antenna radiator; a connector member electrically connected to a ground; a dielectric interposed between the connector member and the metallic member; a capacitor formed by the connector member and the metallic member; at least one shock protecting element interposed between the capacitor and the ground of the substrate in a ground line; and a switching element interposed between the shock protecting element and the ground. The capacitor is opened from the at least one metallic member in a low frequency band and shorted to the at least one metallic member in a high frequency band according to frequency response characteristics of the capacitor.

BRIEF DESCRIPTION OF THE DRAWINGS

The above and other aspects, features, and advantages of the present invention will become more apparent from the following description taken in conjunction with the accompanying drawings, in which:

FIGS. 11A and 11B are tables of antenna efficiency characteristics per frequency before and after a capacitor is included using a dielectric according to an embodiment of the present invention;

FIG. 12 is a table comparing efficiency characteristics between an antenna of the present invention that includes a capacitor using a dielectric and a conventional antenna.

Throughout the drawings, like reference numerals will be understood to refer to like parts, components and structures.

DETAILED DESCRIPTION EMBODIMENTS OF THE PRESENT INVENTION

Figure 1:
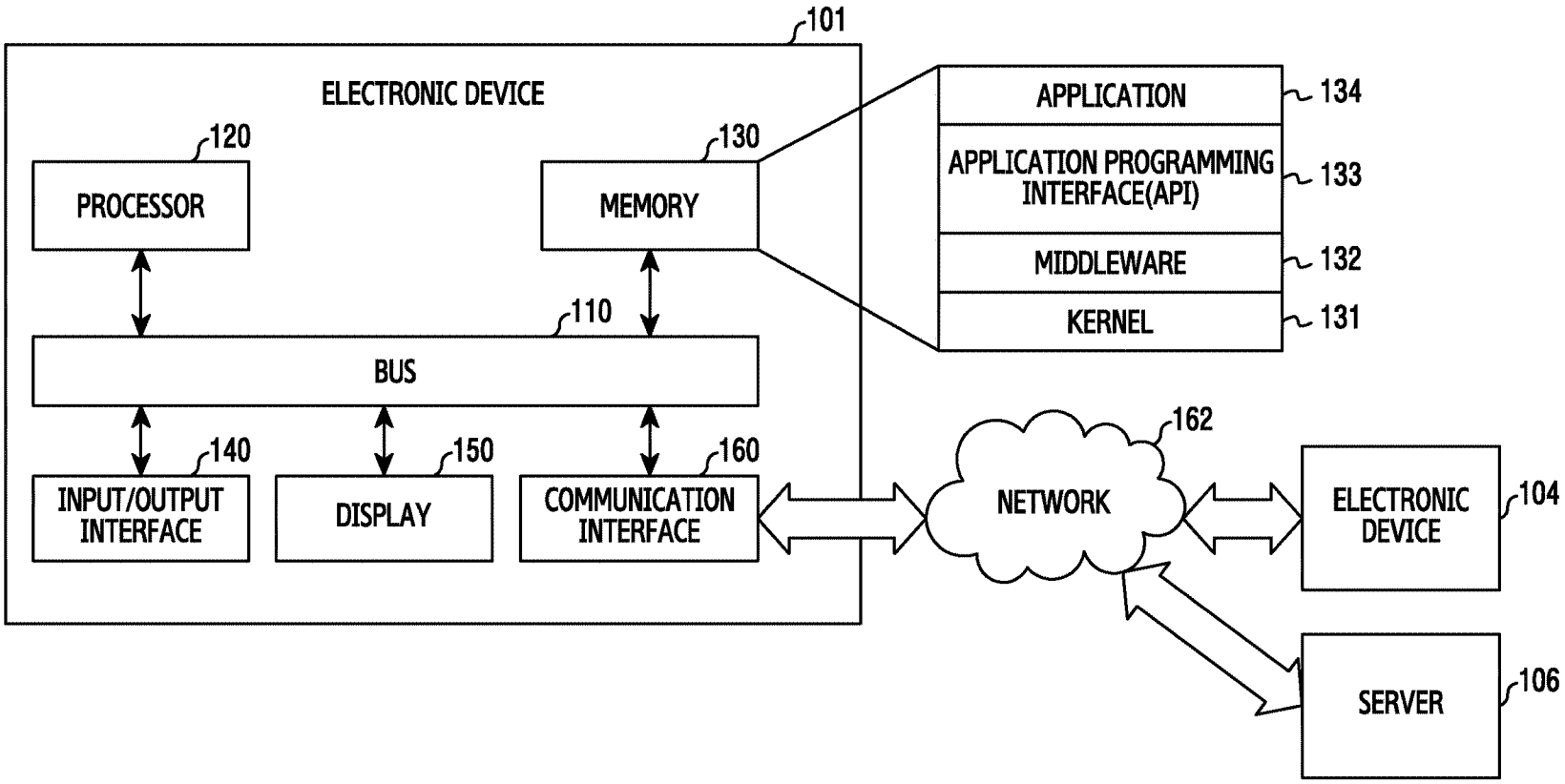
FIG. 1 is a block diagram of a network including an electronic device according to an embodiment of the present invention.

Herein, embodiments of the present invention are described with reference to the accompanying drawings. Although specific embodiments of the present invention are illustrated in the drawings and relevant detailed descriptions are provided to assist in a comprehensive understanding of various embodiments of the present invention, the various specific details in the following description are provided to assist in a comprehensive understanding, but the embodiments are merely examples. Accordingly, those of ordinary skill in the art will recognize that various changes and modifications of the various embodiments described herein can be made without departing from the scope and spirit of the present invention. In addition, descriptions of well-known functions and constructions may be omitted for clarity and conciseness.

The terms and words used in the following description and claims are not limited to their dictionary meanings, but are used to enable a clear and consistent understanding of the present invention. Accordingly, it should be apparent to those skilled in the art that the following description of various embodiments of the present invention is provided for illustration purposes only and not for the purpose of limiting the present invention, as defined by the appended claims and equivalents thereof.

It is to be understood that the singular forms "a," "an," and "the" include plural forms, unless the context clearly indicates otherwise. Thus, for example, reference to "a component surface" includes reference to one or more of such surfaces.

The term "substantially" used in describing the embodiments of the present invention indicates that a recited characteristic, parameter, or value need not be achieved exactly, but that deviations or variations, e.g., tolerances, measurement error, measurement accuracy limitations and other factors known to those of skill in the art, may occur in amounts that do not preclude the effect that the characteristic was intended to provide.

The terms "include" and "may include" used in describing the embodiments of the present invention indicate the presence of one or more corresponding functions, operations, elements and the like, and do not limit additional functions, operations, elements and the like. In addition, the terms "include" and "have" used in describing the embodiments of the present invention indicate that the presence of features, characteristics, numbers, steps, operations, elements, parts and combinations thereof, and do not preclude the presence or addition of one or more other features, numbers, steps, operations, elements, parts, or a combination thereof.

As used herein, the term "or" used in describing the embodiments of the present invention includes any and all combinations of words enumerated together. For example, "A or B" may include either A or B, or may include both A and B.

Although terms such as "1$^{st}$", "2$^{nd}$", "first", "second" used in describing various the various embodiments of the present invention may modify various elements of the various embodiments, these terms do not limit the corresponding elements. For example, these terms do not limit an order or an importance of the corresponding constituent elements. These terms may be used to distinguish one constituent element from another constituent element. For example, a first user device and the second user device are both user devices, and indicate different user devices. For example, a first constituent element may be referred to as a second constituent element, and similarly, the second constituent element may be referred to as the first constituent element without departing from the scope of the present invention.

It will be understood that, when an element is mentioned as being "connected" to or "accessing" another element, the element may be directly connected to, coupled to, or accessing the other element, and there may be intervening elements present between the two elements. On the other hand, when an element is mentioned as being "directly connected" to or "directly accessing" another element, an intervening elements does not exist between the element and another element.

Unless otherwise defined, all terms, including technical and scientific terms, used herein have the same meaning as commonly understood by those of ordinary skill in the art. It will be further understood that terms, such as those defined in commonly used dictionaries, should be interpreted as having a meaning that is consistent with their meaning in the context of the relevant art and the various embodiments of the present invention, and should not be interpreted in an idealized or overly formal sense unless clearly defined herein.

An electronic device according to embodiments of the present invention includes an antenna capable of performing a communication function in at least one frequency band. For example, the electronic device may be a smart phone, a tablet Personal Computer (PC), a mobile phone, a video phone, an e-book reader, a desktop PC, a laptop PC, a netbook computer, a Personal Digital Assistant (PDA), a Portable Multimedia Player (PMP), a Moving Picture Experts Group Phase 1 or phase 2 (MPEG-1 or MPEG-2) audio layer 3 (MP3) player, a mobile medical device, a camera, and a wearable device (e.g., a Head-Mounted-Device (HMD), such as electronic glasses, electronic clothes, an electronic bracelet, an electronic necklace, an electronic appcessory, an electronic tattoo, a smart watch, and the like).

According to certain embodiments of the present invention, the electronic device may be a smart home appliance having an antenna. For example, the smart home appliance may include at least one of a television (TV), a Digital Versatile Disc (DVD) player, an audio player, a refrigerator, an air conditioner, a cleaner, an oven, a microwave oven, a washing machine, an air purifier, a set-top box, a TV box (e.g., Samsung HomeSync™, Apple TV™, or Google TV™), a game console, an electronic dictionary, an electronic key, a camcorder, and an electronic picture frame.

According to certain embodiments of the present invention, the electronic device including the antenna may be one of various medical devices (e.g., Magnetic Resonance Angiography (MRA), Magnetic Resonance Imaging (MRI), Computed Tomography (CT), an imaging equipment, an ultrasonic instrument, and the like), a navigation device, a Global Positioning System (GPS) receiver, an Event Data Recorder (EDR), a Flight Data Recorder (FDR), a car infotainment device, electronic equipment for a ship (e.g., a vessel navigation device, a gyro compass, and the like), avionics, a security device, a car head unit, an industrial or domestic robot, an Automatic Teller Machine (ATM), a Point Of Sales (POS) device, and the like.

According to certain embodiments of the present invention, the electronic device may be part of at least one of an item of furniture or a building/structure including an antenna. The electronic device may be an electronic board, an electronic signature input device, a projector, or any of various measurement machines (e.g., water supply, electricity, gas, a propagation measurement machine, and the like).

The electronic device may be one or more combinations of the aforementioned various devices. In addition, the electronic device may be a flexible device. Moreover, the electronic device is not limited to the aforementioned devices.

Hereinafter, an electronic device according to various embodiments will be described with reference to the accompanying drawings. The term 'user' used in the various embodiments may refer to a person who uses the electronic device or a device which uses the electronic device (e.g., an artificial intelligence (AI) electronic device).

FIG. 1 illustrates a network environment including an electronic device 101 according to an embodiment of the present invention.

Referring to FIG. 1, the electronic device 101 includes a bus 110, a processor 120, a memory 130, an input/output interface 140, a display 150, and a communication interface 160.

The bus 110 is a circuit for connecting the aforementioned elements (e.g., the processor 120, the memory 130, the input/output interface 140, the display 150, and the communication interface 160) to each other and for delivering communication (e.g., a control message) between the aforementioned elements.

The processor 120 receives an instruction from the aforementioned different elements (e.g., the memory 130, the input/output interface 140, the display 150, and the communication interface 160) via the bus 110, and thus may interpret the received instruction and execute arithmetic processing or data processing according to the interpreted instruction.

The memory 130 stores an instruction or data received from the processor 120 or different elements or generated by the processor 120 or the different elements. The memory 130 includes programming modules, such as a kernel 131, a middleware 132, an application programming interface (API) 133, and an application 134. Each of the aforementioned programming modules may consist of software, firmware, or hardware entities or may consist of at least two or more combinations thereof.

The kernel 131 controls or manages the system resources (e.g., the bus 110, the processor 120, the memory 130, and the like) used to execute an operation or function implemented in the middleware 132, the API 133, or the application 134. In addition, the kernel 131 provides a controllable or manageable interface by accessing individual constituent elements of the electronic device 101 in the middleware 132, the API 133, or the application 134.

The middleware 132 performs a mediation role so that the API 133 or the application 134 communicates with the kernel 131 to exchange data. In addition, regarding task requests received from the application 134, the middleware 132 controls (e.g., schedules or load balances) the task requests by using a method of assigning a priority for using a system resource of the electronic device 101 to at least one of the application 134.

The API 133 includes at least one interface or function (e.g., an instruction) for file control, window control, video processing, character control, and the like, as an interface capable of controlling a function provided by the application 134 in the kernel 131 or the middleware 132.

The application 134 may include a Short Message Service (SMS)/Multimedia Messaging Service (MMS) application, an e-mail application, a calendar application, an alarm application, a health care application (e.g., an application for measuring a physical activity level, a blood sugar level, and the like) or an environment information application (e.g., atmospheric pressure, humidity, or temperature information). Additionally or alternatively, the application 134 may be an application related to an information exchange between the electronic device 101 and an external electronic device 104 or a server 106. The application related to the information exchange includes a notification relay application for relaying specific information to the external electronic device 104 or a device management application for managing the external electronic device.

The notification relay application includes a function of relaying notification information generated in another application (e.g., an SMS/MMS application, an e-mail application, a health care application, an environment information application, and the like) of the electronic device 101 to the external electronic device 104 or server 106. Additionally or alternatively, the notification relay application receives notification information from the external electronic device 104, and provides the notification information to the user.

The device management application manages a function for at least one part of the external electronic device 104 which communicates with the electronic device 101. Examples of the function include turning on/turning off the external electronic device 104 itself (or some components thereof) or adjusting illumination or resolution of a display, and managing (e.g., installing, deleting, or updating) an application which operates in the external electronic device 104 or a service (e.g., a call service or a message service) provided by the external electronic device 104.

The application 134 includes an application specified according to attribute information (e.g., an electronic device type) of the external electronic device 104. For example, if the external electronic device 104 is an MP3 player, the application 134 may include an application related to a music play. Similarly, if the external electronic device 104 is a mobile medical device, the application 134 may include an application related to health care. The application 134 may include at least one of a specified application in the electronic device 101 or an application received from the external electronic device 104.

The input/output interface 140 relays an instruction or data input from a user by using a sensor (e.g., an acceleration sensor, a gyro sensor, and the like) or an input device (e.g., a keyboard or a touch screen) to the processor 120, the memory 130, or the communication interface 160, for example, via the bus 110. For example, the input/output interface 140 provides data regarding a user's touch input via the touch screen to the processor 120. In addition, the input/output interface 140 outputs an instruction or data received from the processor 120, the memory 130, or the communication interface 160 to an output device (e.g., a speaker or a display), for example, via the bus 110. For example, the input/output interface 140 outputs audio data provided by using the processor 120 to the user via the speaker.

The display 150 displays a variety of information (e.g., multimedia data or text data) to the user.

The communication interface 160 facilitates communication between the electronic device 101 and the external electronic device 104 or the server 106. The communication interface 160 includes an antenna 500 (FIG. 5), examples of which are described hereinafter. The communication interface 160 may communicate with the external electronic device 104 and the server 106 by being connected with a network 162 through wireless communication or wired communication.

The wireless communication includes, for example, at least one of Wi-Fi, Bluetooth (BT), Near Field Communication (NFC), GPS, and cellular communication (e.g., LTE, LTE-advanced (LTE-A), Code Division Multiple Access (CDMA), wideband CDMA (WCDMA), universal mobile telecommunication system (UMTS), Wireless Broadband (WiBro), Global System for Mobile communication (GSM), and the like).

The wired communication includes, for example, at least one of a Universal Serial Bus (USB), High Definition Multimedia Interface (HDMI), Recommended Standard (RS)-232, and Plain Old Telephone Service (POTS).

The network 162 may be a telecommunications network. The telecommunications network includes at least one of a computer network, Internet, Internet of things, and a telephone network. A protocol (e.g., a transport layer protocol, a data link layer protocol, or a physical layer protocol) for communication between the electronic device 101 and an external electronic device 104 may be supported in at least one of the application 134, the application programming interface 133, the middleware 132, the kernel 131, and the communication interface 160.

The antenna is disposed near, but is not limited to, a metallic battery cover serving as an external housing of the electronic device. For example, the antenna may be designed to surround one or more metallic members, other than the metallic battery cover near the antenna in the electronic device, and at least part of a rim of the electronic device, thus preventing radiation degradation due to a metallic bezel.

Figure 2:
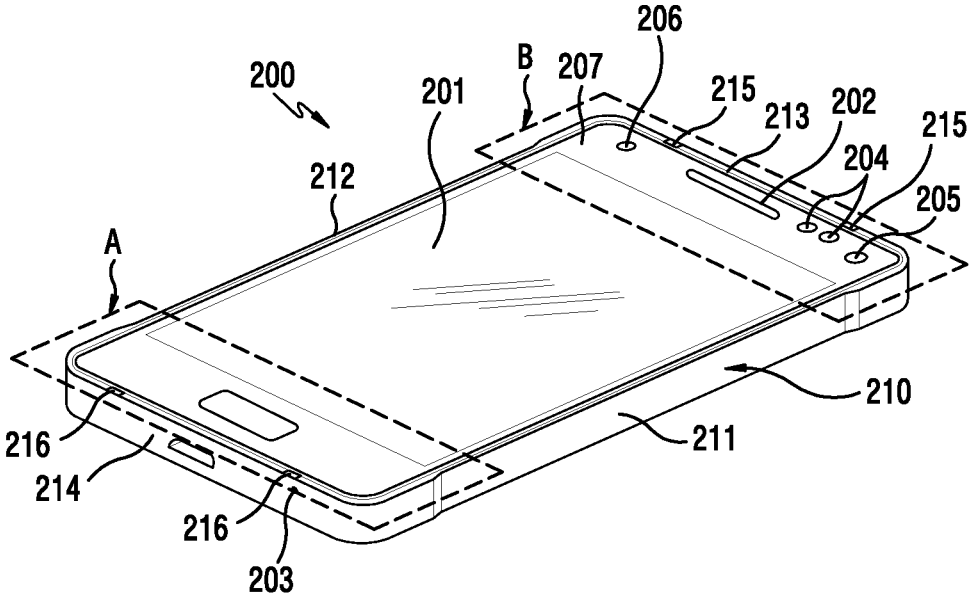
FIG. 2 is a front perspective view of an electronic device including a metallic member according to an embodiment of the present invention.

FIG. 2 is a front perspective view of an electronic device 200 including a metallic member, e.g., a metallic bezel 210, according to an embodiment of the present invention.

Referring to FIG. 2, a display 201 can be disposed in a front side 207 of the electronic device 200. A speaker 202 for reproducing a voice of a counterpart can be disposed above the display 201. A microphone 203 for sending a voice of an electronic device user to the counterpart can be disposed below the display 201.

Various functional components of the electronic device 200 can be disposed near the speaker 202. Such components can include at least one sensor module 204. The sensor module 204 can include at least one of, for example, a light sensor (e.g., an optical sensor), a proximity sensor, an infrared sensor, and an ultrasonic sensor. The components may include a camera 205. The components may include a Light Emitting Diode (LED) indicator 206 for notifying status information of the electronic device 200 to the user.

The electronic device 200 can include a metallic bezel 210 (e.g., serving as at least part of a metallic housing). The metallic bezel 210 can be disposed along a rim of the electronic device 200 and extended to at least part of a rear side of the electronic device 200. The metallic bezel 210 can define, but is not limited to, a thickness of the electronic device 200 along the rim of the electronic device 200, and can be formed in a loop shape. The metallic bezel 210 may be formed to contribute to at least part of the thickness of the electronic device 200. The metallic bezel 210 may be disposed in only at least part of the rim of the electronic device 200. When the metallic bezel 210 serves as part of a housing of the electronic device 200, the remaining housing can be replaced by a nonmetallic member. In this case, the metallic bezel 210 can be formed by insert-molding or assembling the nonmetallic member. The metallic bezel 210 may include at least one segment 215 and 216, and unit bezels 213 and 214 divided by the segments 215 and 216 may be used as an antenna radiator.

The metallic bezel 210 can be in a loop shape along the rim and contribute to the whole thickness of the electronic device 200. When the electronic device 200 is viewed from the front, the metallic bezel 210 can include a right bezel 211, a left bezel 212, an upper bezel 213, and a lower bezel 214. Herein, the upper and lower bezels 213 and 214 can be formed by the segments 215 and 216.

The antenna can be disposed in, but is not limited to, an area A or an area B of the electronic device 200 which is least affected when the user grips the electronic device 200. Besides the area A or the area B, the antenna may be disposed in at least one of both sides of the electronic device 200 in a longitudinal direction.

Figure 3:
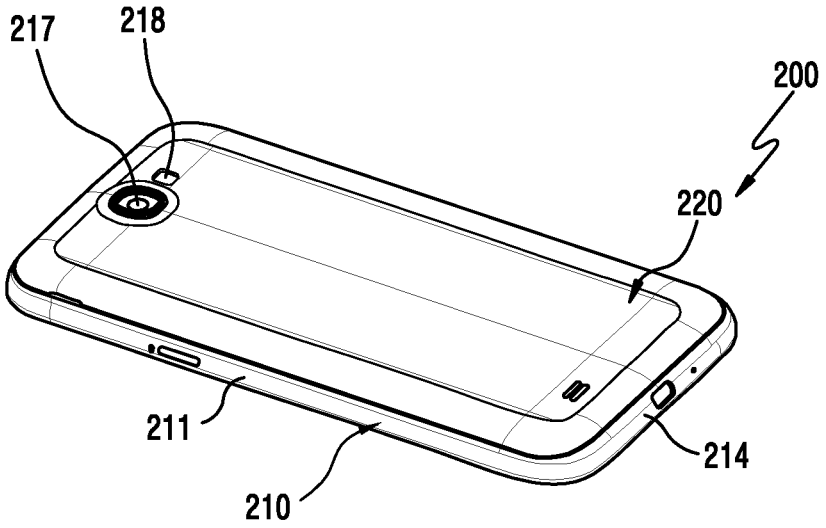
FIG. 3 is a rear perspective view of an electronic device including a metallic member according to an embodiment of the present invention.

FIG. 3 is a rear perspective view of an electronic device 200 including a metallic member 220, e.g., a metallic cover member, according to an embodiment of the present invention.

Referring to FIG. 3, a cover member 220 can be further disposed on the back side of the electronic device 200. The cover member 220 can be, but is not limited to, a battery cover for protecting a battery pack 232 (FIG. 4A) detachable from the electronic device 200 and decorating the exterior of the electronic device 200. The cover member 220 may be integrated with the electronic device 200 and serve as an external housing of the electronic device 200. The back side of the electronic device 200 can include a camera 217 and a flash 218.

The metallic bezel 210 can be extended to at least part of the cover member 220. In this case, the extended metallic material portion of the metallic bezel 210 and the cover member 220 can be unified, the other portion can be formed of a synthetic resin material, and thus a single cover member can be completed using insert-molding or assembling.

When the battery pack is built in the electronic device, the cover member may be replaced by the external housing of the electronic device. In this case, at least part of the external housing which forms the exterior of the electronic device may be formed of a metallic material.

Figure 4A:
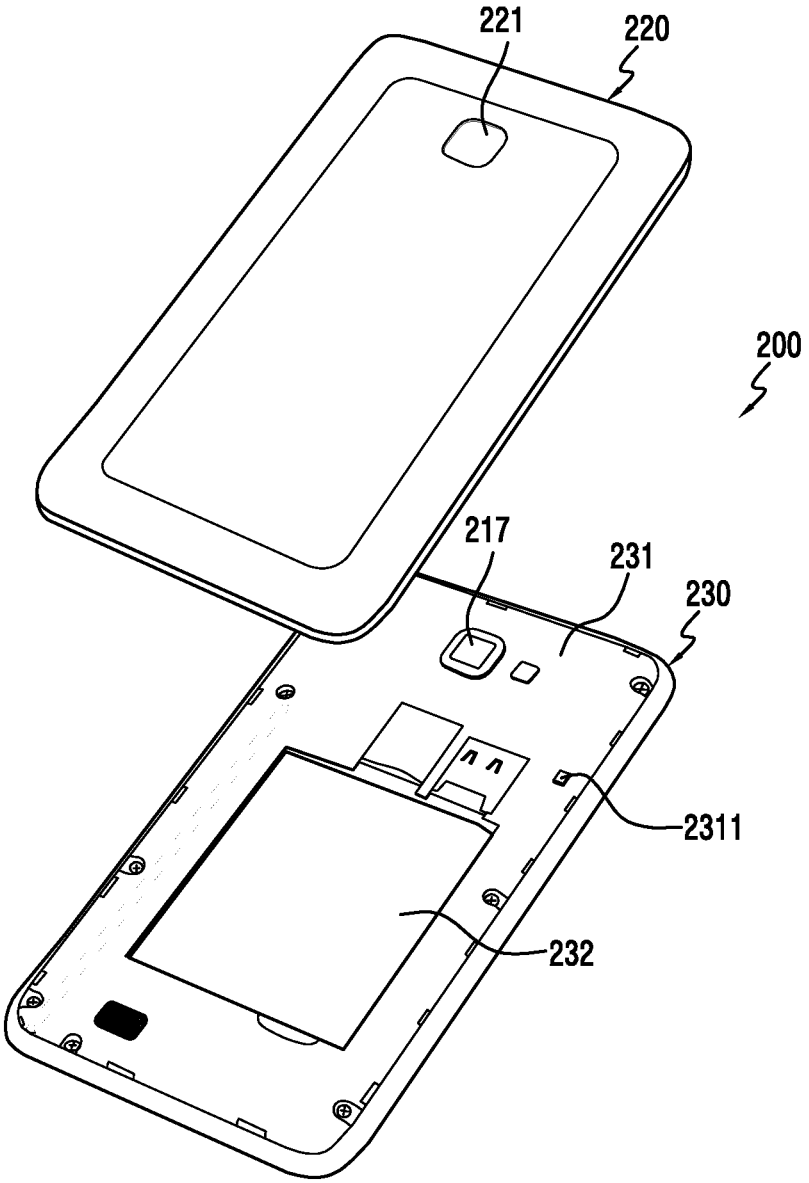
FIG. 4A is an exploded perspective view of a cover member being a metallic member separated from an electronic device according to an embodiment of the present invention.
Figure 4B:
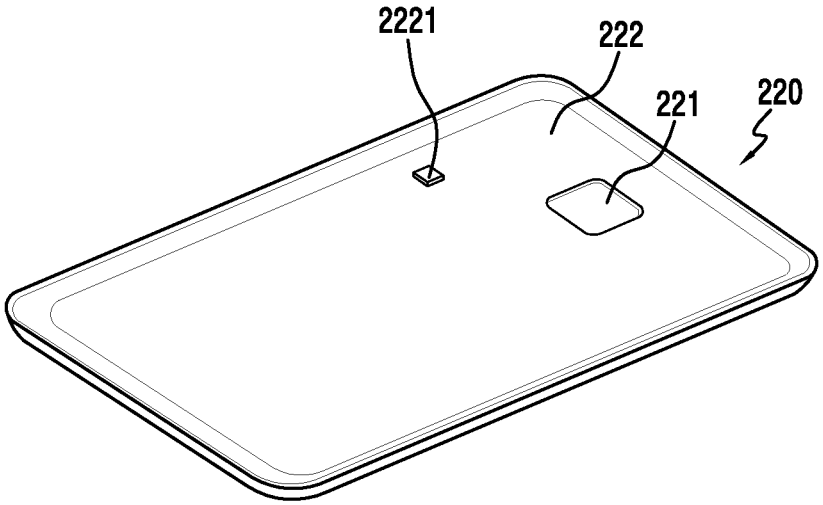
FIG. 4B is a perspective view of an inner side of a cover member according to an embodiment of the present invention.

FIG. 4A is an exploded perspective view of a cover member 220 being a metallic member separated from an electronic device 200 according to an embodiment of the present invention. FIG. 4B is a perspective view of an inner side of a cover member 220 according to an embodiment of the present invention.

Referring to FIGS. 4A and 4B, the electronic device 200 can include a main body 230 and the cover member 220 detachable from the back side of the main body 230. The cover member 220 can serve as, but is not limited to, a battery cover of the electronic device 200. For example, the cover member 220 can employ various device structures detachable from the main body 230 of the electronic device 200. The cover member 220 can be formed of a metallic material so that at least part of the cover member 220 can affect radiation of the nearby antenna mounted.

As shown in FIG. 4A, when the cover member 220 is detached from the main body 230 of the electronic device 200, a replaceable battery pack 232 can be exposed. The camera 217 can be disposed in a cover mounting portion 231 of the main body 230 with the cover member 220 of the main body 230 detached. When the cover member 220 is attached to the main body 230, the camera 217 can be exposed through an opening 221 of the cover member 220.

The cover member 220 of the metallic material can be selectively grounded to a ground on a substrate of the electronic device 200. The cover mounting portion 231 of the main body 220 can include a connector member 2311 mounted on the substrate and partially exposed. The connector member 2311 can use various conductive materials such as a C-clip, a bushing, an elastic spring, and conductive tape.

As shown in FIG. 4B, the cover member 220 can include an inner side 222 corresponding to the cover mounting portion 231 of the main body 230. The inner side 222 can include a dielectric 2221 of certain thickness and area. When the cover member 220 is mounted to the cover mounting portion 231 of the main body 230, the dielectric 2221 corresponds to the location of the exposed connector member 2311 of the cover mounting portion 231. When the cover member 220 is attached to the electronic device 200, the dielectric 2221 closely contacts the connector member 2311. The dielectric 2221 can use a nonconductive member (e.g., an insulating tape, an insulating poron sheet, a thin plate such as PC material) with certain thickness, area, and material.

The antenna can include a ground structure realized as a capacitor by physically contacting the metallic cover member 220 and the connector member 2231 via the dielectric 2221. Since the capacitor physically contacts the metallic member at a final end of a grounding line of the substrate, it is not affected by various intermediate elements (e.g., an anti-electric shock protecting element, a shunt inductor) disposed on the grounding line of the substrate and can realize ideal switching of the metallic member according to an operating frequency bandwidth.

Figure 5:
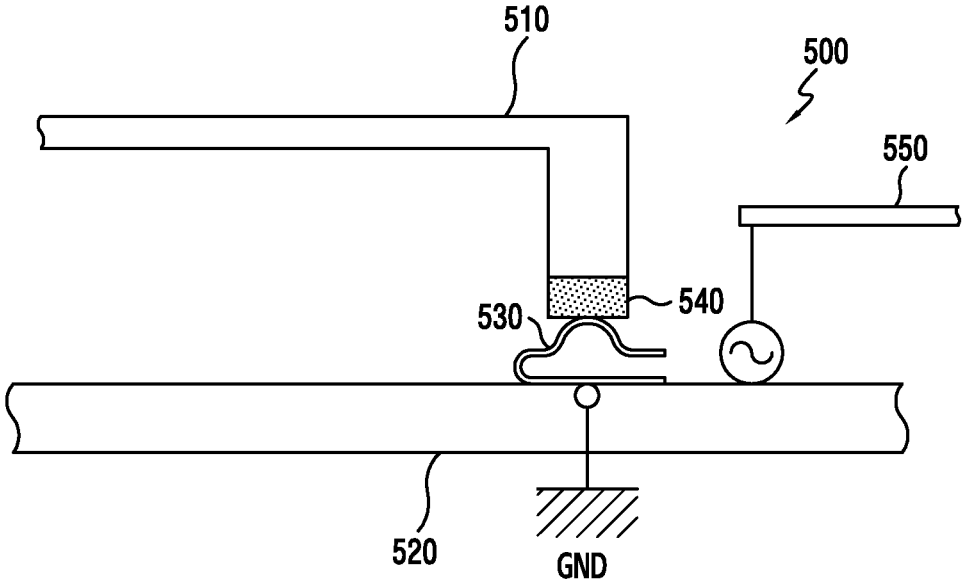
FIG. 5 is a diagram of an antenna according to an embodiment of the present invention.

FIG. 5 is a diagram of an antenna 500 according to an embodiment of the present invention.

An antenna radiator 550 is disposed in the electronic device 200. The antenna radiator 550 can be patterned on a substrate 520. The antenna radiator 550 may be in-molded into an antenna carrier on the substrate 520. The antenna radiator 550 is electrically connected and fed by a Radio Frequency (RF) stage of the substrate 520.

A metallic member 510 can be disposed near the antenna radiator 550. The metallic member 510 can be part (e.g., a metallic case frame, a metallic bezel, a metallic battery cover) of an external housing of the electronic device 200. The metallic member 510 may be at least one metallic component in the electronic device.

The metallic member 510 can degrade radiation of the antenna radiator 550. The metallic member 510 is selectively grounded to the substrate 520 and affects the antenna radiation according to the grounding. Opening the metallic member 510 from the ground of the substrate 520, yields good radiation in a first frequency band (e.g., a low frequency band). Shorting the metallic member 510 to the ground of the substrate 520, yields good radiation in a second frequency band (e.g., a high frequency band). A connector member 530 is mounted and electrically connected in a ground area of the substrate 520. The metallic member 510 includes a dielectric 540 formed of an insulating material with a certain area and thickness. When the electronic device is completely assembled, the dielectric 540 of the metallic material 510 is in close physical contact with the connector member 530 and serves as a capacitor, together with two conductors, i.e., the metallic member 510 and the connector member 530.

As shown in FIG. 5, the dielectric 540 is attached to the metallic member 510, but is not so limited. For example, the dielectric 540 may be attached directly to a ground pad of the substrate 520, rather than the metallic member 510, and part of the metallic member 510 can contact the dielectric 540. The dielectric 540 may be attached directly to the top of the connector member 530 or the substrate 520, rather than the metallic member 510, and part of the metallic member 510 can contact the dielectric 540.

Assembly of the dielectric 540 of the metallic material 510 in close physical contact with the connector member 530 serves as a capacitor, together with the metallic member 510 and the connector member, and the capacitor realizes capacitance. The capacitor is opened at a low frequency and shorted at a high frequency according to general characteristics thereof. Ideally, the ground is opened at a low frequency, and the ground is shorted at a high frequency, in corresponding frequency bands. Hence, the antenna radiation is enhanced by blocking a noise component, i.e., Direct Current noise from DC to approximately hundreds of MHz bands, such as a memory clock and multiple components thereof, an Application Processor (AP) clock and multiple components thereof, in the low frequency band from leaking to the antenna radiator through the ground.

Figure 6:
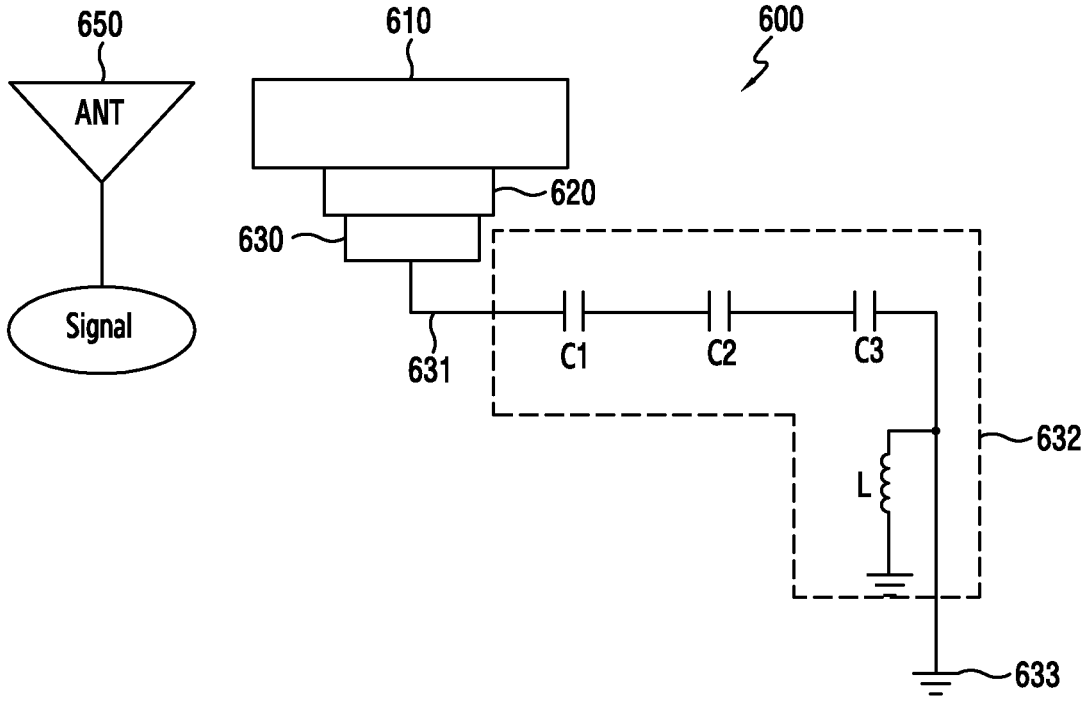
FIG. 6 is an equivalent circuit diagram of an antenna according to an embodiment of the present invention.

FIG. 6 is an equivalent circuit diagram of an antenna 600 according to an embodiment of the present invention.

Referring to FIG. 6, a ground structure 633 is deposed near an antenna radiator 650. A metallic member 610 near the antenna radiator 650 physically contacts a connector member 630 mounted on a substrate via a dielectric 620. The connector member 630 is disposed at a final end contacting the metallic member 610 of a ground line 631 of the substrate. At least one intermediate element 632 is disposed in the ground line 631 of the substrate. The intermediate element 632 can use a shock protecting element for avoiding an electric shock when the metallic member is gripped and protecting a substrate circuit. The shock protecting element includes, but is not limited to, three capacitors (C1, C2, C3) and one inductor (L).

The metallic member 610, the metallic connector member 630, and the dielectric 620 form a capacitor. According to the frequency characteristics of the antenna radiator 650, the capacitor opens the metallic member 610 and the substrate ground in the low frequency band and shorts the metallic member 610 and the substrate ground in the high frequency band. Thus, the antenna 600 produces optimal radiation in the corresponding frequency band. Since the metallic member 610 and the substrate ground are opened in a relatively low frequency band according to the characteristics of the capacitor, the radiation of the antenna 600 is improved by blocking the noise component, i.e., DC noise to approximately hundreds of MHz bands, such as the memory clock and multiple components thereof, and the AP clock and multiple components thereof, in the low frequency band from leaking to the antenna radiator through the ground.

Figure 7:
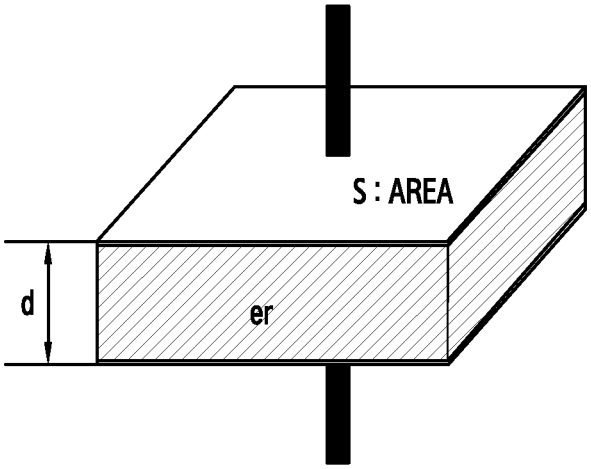
FIG. 7 is a schematic diagram of capacitance calculation of a dielectric between two metallic plates according to an embodiment of the present invention.

FIG. 7 is a schematic diagram of capacitance calculation of a dielectric between two metallic plates according to an embodiment of the present invention.

Referring to FIG. 7, an area S of each metallic plate of two metallic plates can be calculated from a capacitance C using a permittivity of the dielectric between the two metallic plates based on Equation (1).

$$C = \varepsilon \frac{S}{d} \quad (1)$$

C denotes the capacitance between the two metallic plates, S denotes the area of the metallic plate, d denotes a spacing between the two metallic plates, and ε is εr×ε0 (εr: relative permittivity, ε0=8.854×10−12). That is, an intended capacitance C (e.g., Cp1, Cp2) can be calculated based on relations that the capacitance C is inversely proportional to the spacing d of the two metallic plates and proportional to the plate area S. Hence, when C is given based on impedance in a desired frequency band, the contact area S of the two metallic plates based on the spacing can be calculated.

The two plates can include the metallic member and the connector member. The contact area of the metallic member and the connector member can be calculated based on Equation (1) and the ideal C can be attained.

Figure 8A:
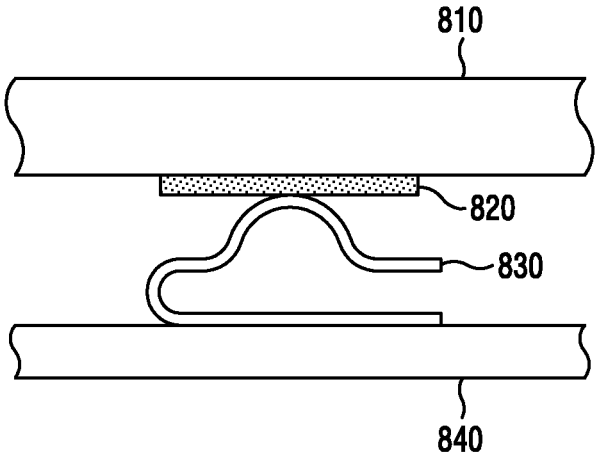
FIGS. 8A and 8B illustrate a dielectric disposed below a metallic member according to embodiments of the present invention.
Figure 8B:
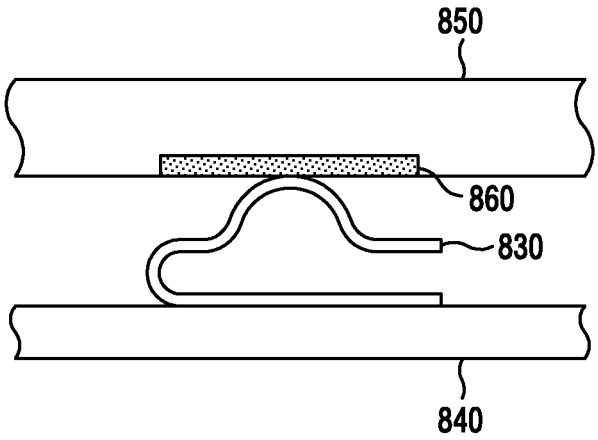

FIGS. 8A and 8B illustrate a dielectric 820 and 860 disposed below a metallic member 810 and 850, respectively, according to embodiments of the present invention.

Referring to FIG. 8A, the dielectric 820 is disposed below the metallic member 810, and a connector member 830 electrically connected to a ground is disposed on a substrate 840. The dielectric 820 of the metallic member 810 physically contacts a connector member 830.

The dielectric 820 of the metallic member 810 is attached to an inner side of the metallic member 810. When the dielectric 820 is rigid, the dielectric 820 can be bonded or attached to the inner side of the metallic member 810 using a double-sided tape. An insulating tape can be directly attached to the dielectric 820.

Referring to FIG. 8B, the dielectric 860 is disposed in the metallic member 850, and the connector member 830 electrically connected to the ground is disposed on the substrate 840. The dielectric 860 of the metallic member 850 physically contacts the connector member 830. The dielectric is molded in the inner side of the metallic member 850. The dielectric 860 may be exposed to the inner side of the metallic member 850 at the same height as the inner side. The dielectric 860 may be exposed to the inner side of the metallic member 850 at a height lower or higher than the inner side. The connector member 830 produces capacitance for filtering a desired frequency by adjusting the contact area of the dielectric 860.

The two plates shown in FIG. 7 correspond to the metallic member 810 and 850 in FIGS. 8A and 8B, respectively, and the connector member 830. In this case, the capacitance can be changed to a desired value by altering at least one parameter of the contact area of the metallic member 810 and 850 and the connector member 830, and the dielectric 820 and 860, a dielectric material, and a dielectric thickness. The dielectric can be elastic. In this case, the area and the thickness of the dielectric contacting the connector member may differ according to the hardness.

Figure 9A:
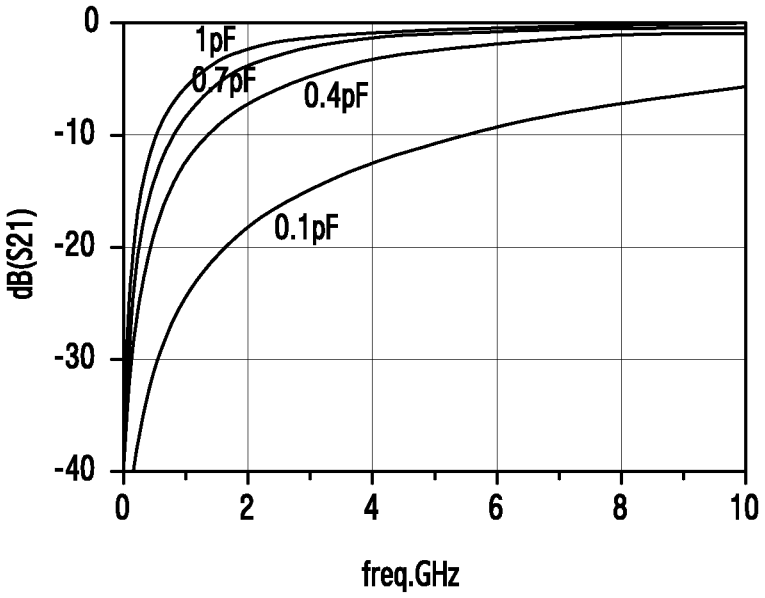
FIGS. 9A and 9B are graphs comparing frequency response characteristics between an ideal capacitor and a capacitor of an embodiment of the present invention.
Figure 9B:
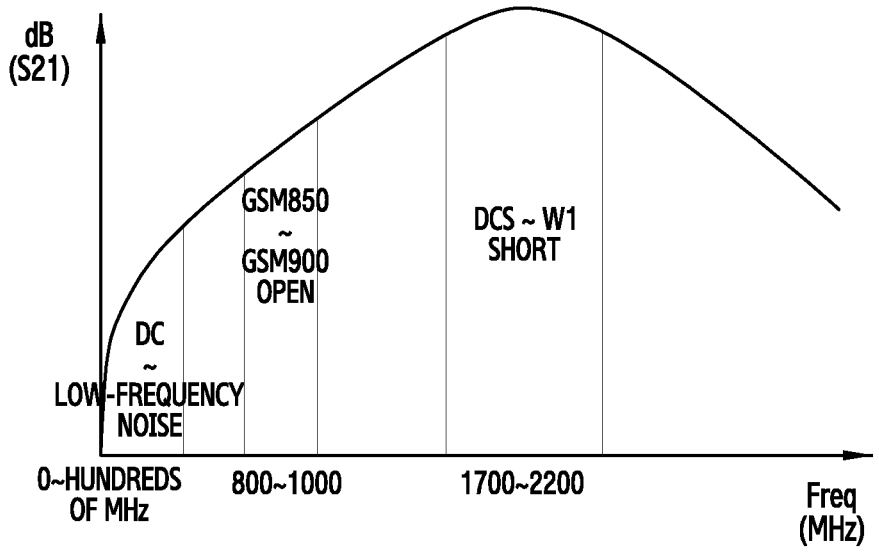

FIGS. 9A and 9B are graphs comparing frequency response characteristics in decibels (S(2,1)) between an ideal capacitor and a capacitor of an embodiment of the present invention, i.e., the present capacitor FIG. 9A is a graph of ideal frequency response characteristics of an ideal capacitor, which is opened in a low frequency band and shorted in a high frequency band.

FIG. 9B is a graph of frequency response characteristics of the capacitor of the present invention including the dielectric between the metallic member and the connector member electrically connected to the ground of the substrate, which is opened in a low frequency band and shorted in a high frequency band. The capacitor of the present invention is opened in a low frequency band of Global System for Mobile communications (GSM) 850~GSM 900 and shorted in a high frequency band of DCS~W1 (1700~2200 MHz). The capacitor of the present invention is also opened with the metallic member in the low frequency band and thus prevents noise in the low frequency band (0~hundreds of MHz).

The capacitor of the present invention including the dielectric between the metallic member and the connector member electrically connected to the substrate ground can automatically switch the electrical connection between the substrate ground and the metallic member according to the operating frequency band of the antenna radiator.

Figure 10:
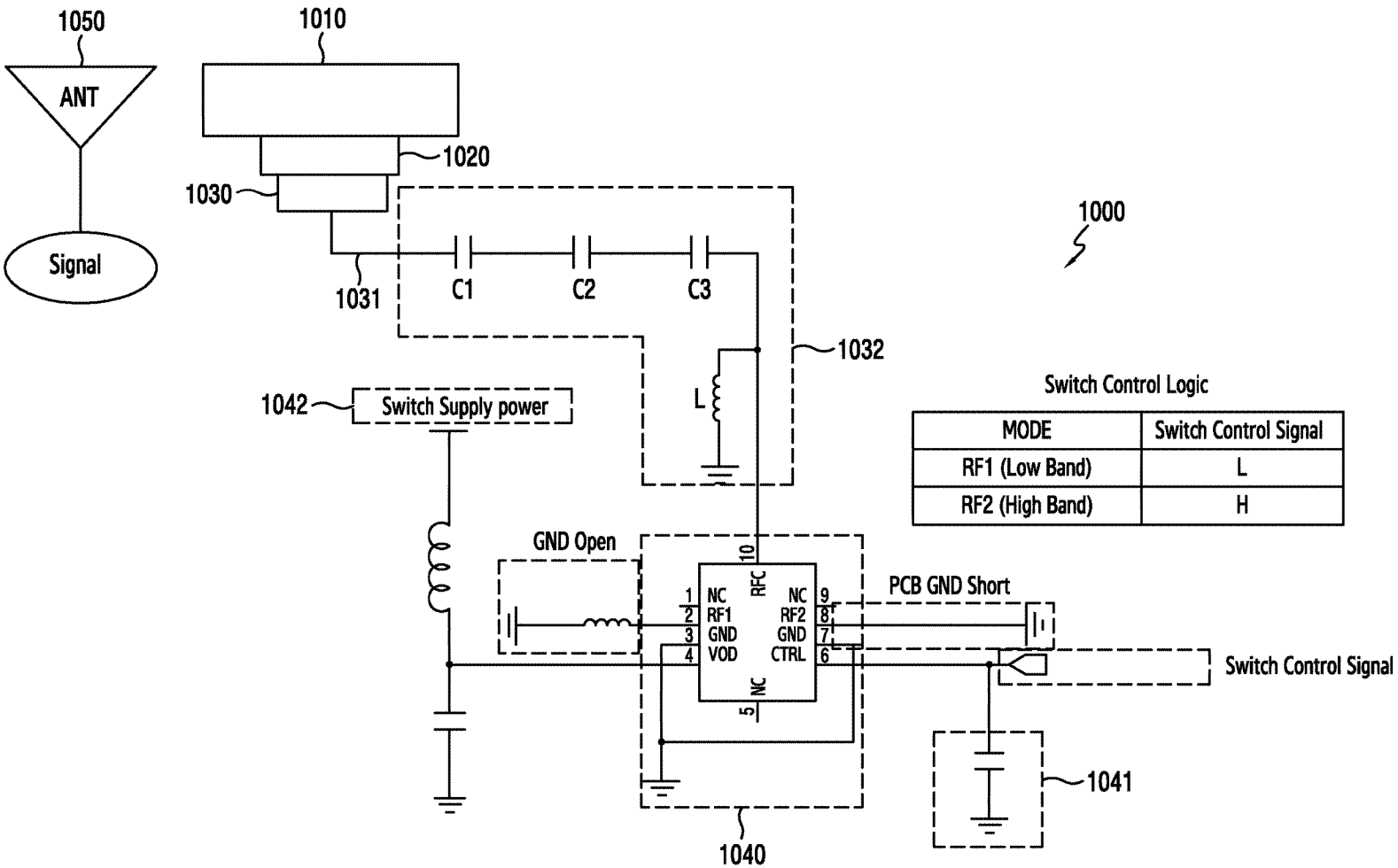
FIG. 10 is an equivalent circuit diagram of an antenna including a switch according to an embodiment of the present invention.

FIG. 10 is an equivalent circuit diagram of an antenna 1000 including a switch 1040 according to an embodiment of the present invention.

Referring to FIG. 10, a ground structure is disposed near an antenna radiator 1050. A metallic member 1010 disposed near the antenna radiator 1050 physically contacts a connector member 1030 mounted on a substrate via a dielectric 1020. The connector member 1030 is disposed at a final end contacts the metallic member 1010 and a ground line 1031 of the substrate. The ground line 1031 of the substrate includes at least one intermediate element 1032. The intermediate element 1032 provides a shock protecting element for avoiding an electric shock when the metallic member is gripped and protecting a substrate circuit. The shock protecting element includes, but is not limited to, three capacitors (C1, C2, C3) and one inductor (L).

A switch (e.g., Single-Pole Double-Throw (SPDT) switch) 1040 is disposed in the ground line 1031 between the intermediate element 1032 and the substrate ground. The switch 1040 can be operated with switch supply power 1042 and switch control power 1041. The switch 1040 passes through a second pin in a low frequency band and the ground is opened. The switch 1040 passes through an eighth pin in a high frequency band and the ground is shorted.

The capacitor may use the at least one metallic member or the antenna radiator as a parasitic element for an auxiliary antenna radiator by selectively connecting the at least one metallic member.

FIGS. 11A and 11B are tables of antenna efficiency characteristics per frequency before and after including a capacitor using a dielectric according to an embodiment of the present invention.

FIGS. 11A and 11B show the efficiency characteristics of the antenna according to the presence and the absence of the capacitor of the present invention that includes the dielectric between the metallic member and the connector member electrically connected to the substrate ground in the ground structure of the antenna including the switch.

A conventional antenna without the capacitor exhibits the efficiency characteristics of 31.4% and 30.1% on an average in the low frequency band, whereas the antenna of the present invention exhibits relatively better efficiency characteristics of 32.8% and 31.0% on an average in the same low frequency band.

The conventional antenna without the capacitor exhibits the efficiency characteristics of 36.4% and 32.3% on an average in the high frequency band, whereas the antenna of the present invention exhibits relatively better efficiency characteristics of 40.8% and 34.4% on an average in the same high frequency band.

FIG. 12 is a table comparing efficiency characteristics of the antenna (antenna 3) of the present invention that includes the capacitor using the dielectric and the conventional antennas (antennas 1 and 2).

Referring to FIG. 12, the first antenna exhibits the efficiency characteristics in optimal designs for a low frequency band and a high frequency band. The second antenna exhibits the efficiency characteristics with the presence of the switch. The efficiency of the second antenna increases in both of the low and high frequency bands, compared to the first antenna without the switch.

The third antenna exhibits the efficiency characteristics using the capacitor which includes the dielectric between the metallic member and the connector member electrically connected to the substrate ground. The efficiency of the third antenna increases in the low and high frequency bands, compared to the second antenna.

When the dielectric is inserted between the substrate and the metallic member, the capacitor is opened in the low frequency and shorted in the high frequency according to its characteristics. Thus, the ideal ground open is realized in the low frequency, and the ground is shorted only at the high frequency in the corresponding frequency band. Therefore, the radiation of the antenna is improved by blocking the noise component, i.e., DC noise to noise of approximately hundreds of MHz bands, such as the memory clock and multiple components thereof, the AP clock and multiple component thereof, in the low frequency band from leaking to the antenna radiator through the ground.

Figure 13:
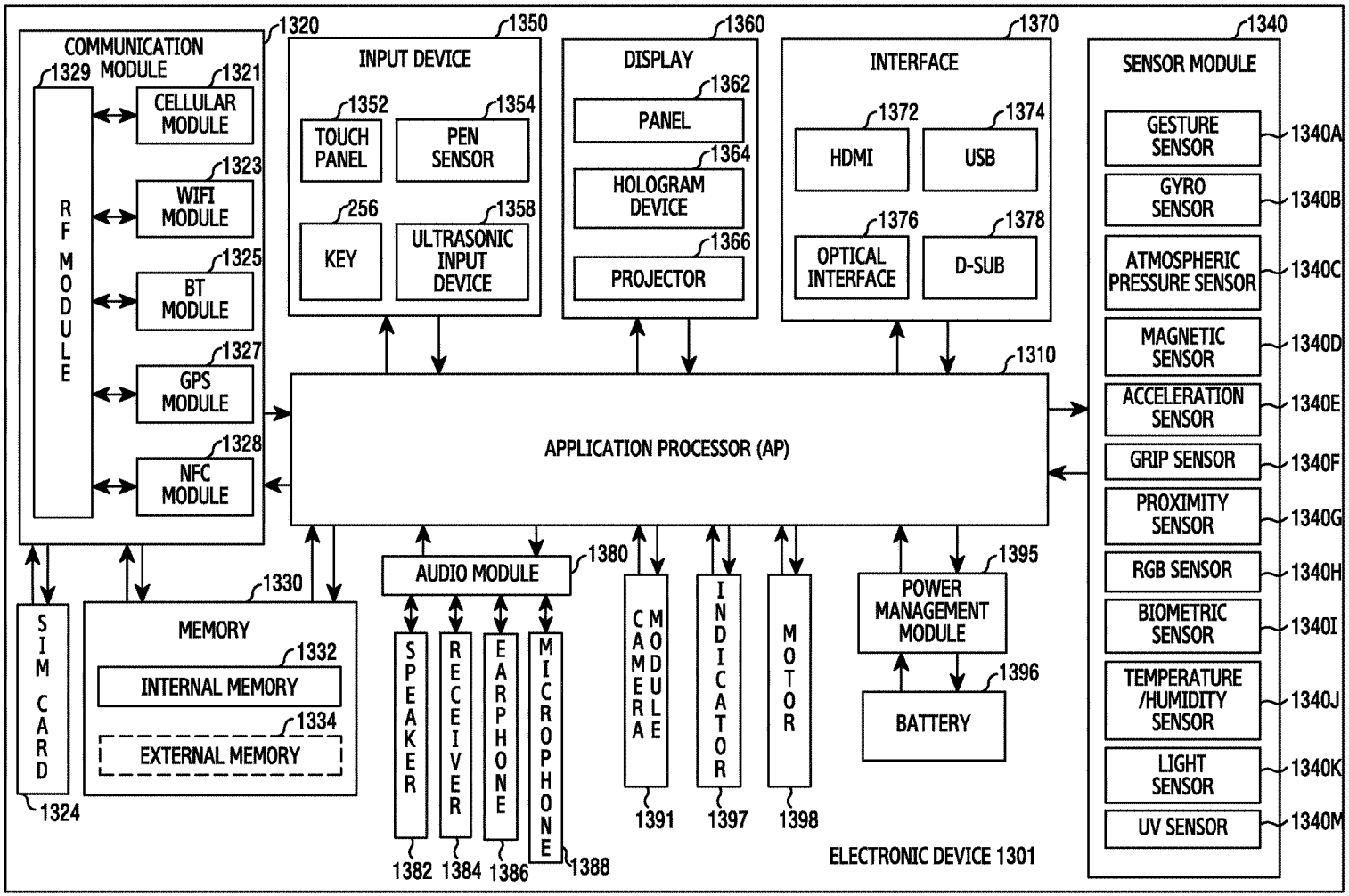
FIG. 13 is a block diagram of an electronic device according to an embodiment of the present invention.

FIG. 13 is a block diagram of a configuration of an electronic device according to an embodiment of the present invention.

Referring to FIG. 13, a configuration of electronic device 1301 is provided. The electronic device 1301 may entirely or partially constitute the electronic device 101 of FIG. 1, the device 200 of FIGS. 2A, 2B, and 3. Electronic device 1301 includes at least one AP 1310, a communication module 1320, a subscriber identification module (SIM) card 1324, a memory 1330, a sensor module 1340, an input device 1350, a display 1360, an interface 1370, an audio module 1380, a camera module 1391, a power management module 1395, a battery 1396, an indicator 1397, and a motor 1398.

The AP 1310 controls a plurality of hardware or software elements connected to the AP 1310 by driving an operating system or an application program. The AP 1310 processes a variety of data, including multimedia data, and performs arithmetic operations. The AP 1310 may be implemented, for example, with a System on Chip (SoC). The AP 1310 may further include a Graphical Processing Unit (GPU).

The communication module 1320 (e.g., the communication interface 160) performs data transmission/reception in communication between other electronic devices (e.g., the external electronic device 104 or the server 106) connected with the electronic device 1301 through a network. The communication module 1320 includes a cellular module 1321, a Wi-Fi module 1323, a BT module 1325, a GPS module 1327, a NFC module 1328, and a radio frequency (RF) module 1329.

The cellular module 1321 provides a voice call, a video call, a text service, an internet service, and the like, through a communication network (e.g., LTE, LTE-A, CDMA, WCDMA, UMTS, WiBro, and GSM, and the like). In addition, the cellular module 1321 identifies and authenticates the electronic device 1301 within the communication network by using a SIM card 1324. The cellular module 1321 may perform at least some of functions that can be provided by the AP 1310. For example, the cellular module 1321 may perform at least some of multimedia control functions.

The cellular module 1321 includes a Communication Processor (CP). Further, the cellular module 1321 may be implemented, for example, with an SoC. Although elements, such as the cellular module 1321 (e.g., the CP), the memory 1330, and the power management module 1395 are illustrated as separate elements with respect to the AP 1310 in FIG. 13, the AP 1310 may also be implemented such that at least one part (e.g., the cellular module 1321) of the aforementioned elements is included in the AP 1310.

The AP 1310 or the cellular module 1321 (e.g., the CP) loads an instruction or data, which is received from each non-volatile memory connected thereto or at least one of different elements, to a volatile memory and processes the instruction or data. In addition, the AP 1310 or the cellular module 1321 stores data, which is received from at least one of different elements or generated by at least one of different elements, into the non-volatile memory.

Each of the Wi-Fi module 1323, the BT module 1325, the GPS module 1327, and the NFC module 1328 includes a processor for processing data transmitted/received through a corresponding module. Although the cellular module 1321, the Wi-Fi module 1323, the BT module 1325, the GPS module 1327, and the NFC module 1328 are illustrated in FIG. 13 as separate blocks, according to an embodiment of the present invention, at least some (e.g., two or more) of the cellular module 1321, the Wi-Fi module 1323, the BT module 1325, the GPS module 1327, and the NFC module 1328 may be included in one integrated chip (IC) or IC package. For example, at least some of processors corresponding to the cellular module 1321, the Wi-Fi module 1323, the BT module 1325, the GPS module 1327, and the NFC module 1328 (e.g., a communication processor corresponding to the cellular module 1321 and a Wi-Fi processor corresponding to the Wi-Fi module 1323) may be implemented with an SoC.

The RF module 1329 transmits/receives data, for example an RF signal. The RF module 1329 may include, for example, a transceiver, a Power Amp Module (PAM), a frequency filter, a Low Noise Amplifier (LNA), and the like. In addition, the RF module 1329 may further include a component for transmitting/receiving a radio wave on a free space in wireless communication, for example, a conductor, a conducting wire, and the like. Although it is illustrated in FIG. 13 that the cellular module 1321, the Wi-Fi module 1323, the BT module 1325, the GPS module 1327, and the NFC module 1328 share one RF module 1329, according to an embodiment of the present invention, at least one of the cellular module 1321, the Wi-Fi module 1323, the BT module 1325, the GPS module 1327, the NFC module 1328 may transmit/receive an RF signal via a separate RF module.

The SIM card 1324 is inserted into a slot formed at a specific location of the electronic device 1301. The SIM card 1324 includes unique identification information (e.g., an Integrated Circuit Card IDentifier (ICCID)) or subscriber information (e.g., an International Mobile Subscriber Identity (IMSI)).

The memory 1330 (e.g., the memory 130) includes an internal memory 1332 or an external memory 1334.

The internal memory 1332 may include, for example, at least one of a volatile memory (e.g., a Dynamic Random Access Memory (DRAM), a Static RAM (SRAM), a Synchronous Dynamic RAM (SDRAM), and the like) or a non-volatile memory (e.g., a One-Time Programmable Read Only Memory (OTPROM), a Programmable ROM (PROM), an Erasable and Programmable ROM (EPROM), an electrically erasable and programmable ROM (EEPROM), a mask ROM, a flash ROM, a Not AND (NAND) flash memory, a Not OR (NOR) flash memory, and the like). The internal memory 1332 may be a solid state drive (SSD).

The external memory 1334 may include a flash drive, and may further include, for example, Compact Flash (CF), Secure Digital (SD), micro-SD, mini-SD, extreme digital (xD), memory stick, and the like. The external memory 1334 may be operatively coupled to the electronic device 1301 via various interfaces.

The electronic device 1301 may further include a storage unit (or a storage medium), such as a hard drive.

The sensor module 1340 measures a physical quantity or detects an operation state of the electronic device 1301, and converts the measured or detected information into an electric signal. The sensor module 1340 includes, for example, at least one of a gesture sensor 1340A, a gyro sensor 1340B, a barometric pressure sensor 1340C, a magnetic sensor 1340D, an acceleration sensor 1340E, a grip sensor 1340F, a proximity sensor 1340G, a color sensor 1340H (e.g., a red, green, blue (RGB) sensor), a biometric sensor 1340I, a temperature/humidity sensor 1340J, an illumination sensor 1340K, and an ultraviolet (UV) sensor 1340M. Additionally or alternatively, the sensor module 1340 may include, for example, an E-node sensor, an electromyography (EMG) sensor, an electroencephalogram (EEG) sensor, an electrocardiogram (ECG) sensor, a fingerprint sensor, and the like. The sensor module 1340 may further include a control circuit for controlling at least one or more sensors included therein.

The input device 1350 includes a touch panel 1352, a (digital) pen sensor 1354, a key 256, or an ultrasonic input unit 1358.

The touch panel 1352 recognizes a touch input, for example, by using at least one of an electrostatic type, a pressure-sensitive type, and an ultrasonic type. The touch panel 1352 may further include a control circuit. In case of the electrostatic type of touch panel 1352, not only is physical contact recognition possible, but proximity recognition is also possible. The touch penal 1352 may further include a tactile layer. In this case, the touch panel 1352 provides the user with a tactile reaction.

The (digital) pen sensor 1354 may be implemented, for example, by using the same or similar method of receiving a touch input of the user or by using an additional sheet for recognition.

The key 1356 may be, for example, a physical button, an optical key, a keypad, or a touch key.

The ultrasonic input unit 1358 is a device by which the electronic device 1301 detects a sound wave through a microphone 1388 by using a pen which generates an ultrasonic signal, and is capable of radio recognition.

The electronic device 1301 may use the communication module 1320 to receive a user input from an external device (e.g., a computer or a server) connected thereto.

The display 1360 (e.g., the display 150) includes a panel 1362, a hologram device 1364, or a projector 1366.

The panel 1362 may be, for example, a Liquid-Crystal Display (LCD), an Active-Matrix Organic Light-Emitting Diode (AM-OLED), and the like. The panel 1362 may be implemented, for example, in a flexible, transparent, or wearable manner. The panel 1362 may be constructed as one module with the touch panel.

The hologram device 1364 uses an interference of light and displays a stereoscopic image in the air.

The projector 1366 displays an image by projecting a light beam onto a screen. The screen may be located inside or outside the electronic device 1301.

The display 1360 may further include a control circuit for controlling the panel 1362, the hologram device 1364, or the projector 1366.

The interface 1370 includes, for example, an HDMI 1372, a USB 1374, an optical communication interface 1376, or a D-subminiature (D-sub) 1378. The interface 1370 may be included, for example, in the communication interface 160 of FIG. 1. Additionally or alternatively, the interface 1370 may include, for example, Mobile High-definition Link (MHL), SD/Multi-Media Card (MMC) or Infrared Data Association (IrDA).

The audio module 1380 bilaterally converts a sound and electric signal. At least some elements of the audio module 1380 may be included in the input/output interface 130 of FIG. 1. The audio module 1380 converts sound information which is input or output through a speaker 1382, a receiver 1384, an earphone 1386, the microphone 1388, and the like.

The camera module 1391 is a device for image and video capturing, and may include one or more image sensors (e.g., a front sensor or a rear sensor), a lens, an Image Signal Processor (ISP), or a flash (e.g., an LED or a xenon lamp).

The power management module 1395 manages power of the electronic device 1301. The power management module 1395 may include a Power Management Integrated Circuit (PMIC), a charger IC, or a battery gauge.

The PMIC may be placed inside an IC or SoC semiconductor. Charging is classified into wired charging and wireless charging. The charger IC charges a battery, and prevents an over-voltage or over-current flow from a charger. The charger IC includes a charger IC for at least one of the wired charging and the wireless charging.

The wireless charging may be classified, for example, into a magnetic resonance type, a magnetic induction type, and an electromagnetic type. An additional circuit for the wireless charging, for example, a coil loop, a resonant circuit, a rectifier, and the like, may be added.

The battery gauge measures, for example, a residual quantity of the battery 1396 and a voltage, current, and temperature during charging. The battery 1396 stores or generates electricity and supplies power to the electronic device 1301 by using the stored or generated electricity. The battery 1396 may include a rechargeable battery or a solar battery.

The indicator 1397 indicates a specific state, for example, a booting state, a message state, a charging state, and the like, of the electronic device 1301 or a part thereof (e.g., the AP 1310).

The motor 1398 converts an electric signal into a mechanical vibration.

The electronic device 1301 includes a General Processing Unit (e.g., a GPU) for supporting mobile TV. The GPU for supporting mobile TV processes media data according to a protocol of, for example, Digital Multimedia Broadcasting (DMB), Digital Video Broadcasting (DVB), media flow, and the like.

Each of the aforementioned elements of the electronic device according to various embodiments of the present invention may consist of one or more components, and names thereof may vary depending on a type of electronic device. The electronic device according to various embodiments of the present invention may include at least one of the aforementioned elements. Some of the elements may be omitted, or additional other elements may be further included. In addition, some of the elements of the electronic device may be combined and constructed as one entity, so as to equally perform functions of corresponding elements before combination.

The term "module" used herein may refer to one of hardware, software, and firmware, or a combination thereof. The term "module" may be interchangeably used with terms, such as unit, logic, logical block, component, circuit, and the like, with the module being a minimum unit of an integrally constituted component or may be a part thereof. The module may be a minimum unit for performing one or more functions, or may be a part thereof, with the module being mechanically or electrically implemented, e.g., by at least one of an application-specific IC (ASIC) chip, a field-programmable gate arrays (FPGAs), and a programmable-logic device.

According to various embodiments of the present invention, at least some parts of a device (e.g., modules or functions thereof) or method (e.g., operations) may be implemented with an instruction stored in a computer-readable storage media for example. The instruction may be executed by one or more processors (e.g., the AP 1310), to perform a function corresponding to the instruction. The computer-readable storage media may be, for example, the memory 1330. At least some parts of the programming module may be implemented (e.g., executed), for example, by the AP 1310. At least some parts of the programming module may include modules, programs, routines, sets of instructions, processes, and the like, for performing one or more functions.

Certain aspects of the present invention can also be embodied as computer readable code on a non-transitory computer readable recording medium. A non-transitory computer readable recording medium is any data storage device that can store data which can be thereafter read by a computer system. Examples of the non-transitory computer readable recording medium include a Read-Only Memory (ROM), a Random-Access Memory (RAM), Compact Disc-ROMs (CD-ROMs), magnetic tapes, floppy disks, and optical data storage devices. The non-transitory computer readable recording medium can also be distributed over network coupled computer systems so that the computer readable code is stored and executed in a distributed fashion. In addition, functional programs, code, and code segments for accomplishing the present invention will be recognized from the disclosure herein and constructed by programmers having ordinary skill skilled in the art.

The various embodiments of the present invention as described above typically involve the processing of input data and the generation of output data to some extent. This input data processing and output data generation may be implemented in hardware or software in combination with hardware. For example, specific electronic components may be employed in a mobile device or similar or related circuitry for implementing the functions associated with the various embodiments of the present invention, as described above. Alternatively, one or more processors operating in accordance with stored instructions may implement the functions associated with the various embodiments of the present invention, as described above. If such is the case, it is within the scope of the present invention that such instructions may be stored on one or more non-transitory processor readable mediums. Examples of the processor readable mediums include a ROM, a RAM, CD-ROMs, magnetic tapes, floppy disks, and optical data storage devices. The processor readable mediums can also be distributed over network coupled computer systems so that the instructions are stored and executed in a distributed fashion. In addition, functional computer programs, instructions, and instruction segments for accomplishing the present invention will be recognized from the disclosure herein and construed by programmers having ordinary skill in the art.

The module or programming module according to various embodiments of the present invention may further include at least one or more elements among the aforementioned elements, may omit some of them, or may further include additional elements. Operations performed by a module, programming module, or other elements may be executed in a sequential, parallel, repetitive, or heuristic manner. In addition, some of the operations may be executed in a different order or may be omitted, or other operations may be added.

While the present invention has been shown and described with reference to certain embodiments thereof, it will be understood by those skilled in the art that various changes in form and details may be made therein without departing from the spirit and scope of the present disclosure, as defined by the appended claims and equivalents thereof.

What is claimed is:

1. An antenna comprising:

a substrate including a ground;

an antenna radiator electrically coupled to the substrate;

at least one metallic member disposed near the antenna radiator and comprising apart of an external housing of the electronic device;

a connector member electrically connected to a ground line of the substrate;

a capacitor formed by a dielectric interposed between the connector member and the at least one metallic member such that in a low frequency band, the at least one metallic member is not electrically connected to the ground of the substrate, an element including at least one capacitor and/or at least one inductor between the connector member and the ground of the substrate in the ground line of the substrate to prevent an electric shock via the at least one metallic member; and a switch between the element and the ground of the substrate in the ground line, wherein, in a high frequency band, the at least one metallic member is electrically connected to the ground of the substrate by the capacitor, wherein, in the low frequency band, the switch is controlled so that the element is electrically connected to the ground of the substrate via an inductor between the switch and the ground of the substrate, and the ground of the substrate is opened in the low frequency band, and wherein, in the high frequency band, the switch is controlled so that the element is electrically connected to the ground of the substrate without passing through any element between the switch and the ground of the substrate.

2. The antenna of claim 1, wherein the dielectric contacts the connector member and the at least one metallic member.

3. The antenna of claim 1, wherein the dielectric is disposed in the at least one metallic member.

4. The antenna of claim 1, wherein the dielectric is attached or molded to the at least one metallic member.

5. The antenna of claim 4, wherein, when the dielectric is molded to a metallic structure, the dielectric is formed at a same, higher or lower height as or than a surface of the metallic structure.

6. The antenna of claim 1, wherein the dielectric is attached to the connector member, and contacts the at least one metallic member.

7. The antenna of claim 1, wherein capacitance of the capacitor is based on a contact area of the connector member or the at least one metallic member and the dielectric, or a thickness or a material of the dielectric.

8. The antenna of claim 1, wherein the at least one metallic member includes at least one of a metallic bezel and a battery cover.

9. The antenna of claim 1, wherein the capacitor is disposed at a final end which is closest to the at least one metallic member in a ground line between the substrate and the at least one metallic member.

10. The antenna of claim 1, wherein the connector member comprises at least one of a C-clip, a bushing, an elastic spring, and conductive tape.

11. The antenna of claim 1, wherein the capacitor is opened from the at least one metallic member in the low frequency band to block noise in the low frequency band.

12. The antenna of claim 1, wherein the connector member is electrically connected to the antenna radiator.

13. The antenna of claim 12, wherein the capacitor uses the at least one metallic member or the antenna radiator as a parasitic element for an auxiliary antenna radiator by selectively connecting the at least one metallic member.

* * * * *